US007705232B2

(12) United States Patent
Glatt

(10) Patent No.: US 7,705,232 B2
(45) **Date of Patent: *Apr. 27, 2010**

(54) MIDI-COMPATIBLE HEARING DEVICE

(75) Inventor: Raoul Glatt, Zurich (CH)

(73) Assignee: Phonak AG, Stafa (CH)

( * ) Notice: Subject to any disclaimer, the term of this patent is extended or adjusted under 35 U.S.C. 154(b) by 0 days.

This patent is subject to a terminal disclaimer.

(21) Appl. No.: 12/269,985

(22) Filed: Nov. 13, 2008

(65) Prior Publication Data

US 2009/0064852 A1 Mar. 12, 2009

Related U.S. Application Data

(63) Continuation of application No. 11/248,045, filed on Oct. 12, 2005, now Pat. No. 7,465,867.

(51) Int. Cl.
*G10H 7/00* (2006.01)
*H04R 25/00* (2006.01)

(52) U.S. Cl. ..... 84/645; 381/312

(58) Field of Classification Search ..... 84/645; 381/312

See application file for complete search history.

(56) References Cited

U.S. PATENT DOCUMENTS

| | | | |
|---|---|---|---|
| 5,606,143 | A | 2/1997 | Young |
| 6,084,516 | A | 7/2000 | Yasushi et al. |
| 6,816,599 | B2 | 11/2004 | Thiede et al. |
| 7,206,429 | B1 | 4/2007 | Vossler |
| 2004/0014459 | A1 | 1/2004 | Shanahan |
| 2004/0267541 | A1 | 12/2004 | Hamalainen et al. |
| 2007/0049788 | A1 | 3/2007 | Kalinowski et al. |

FOREIGN PATENT DOCUMENTS

| | | | |
|---|---|---|---|
| EP | 1168296 | A2 | 1/2002 |
| JP | 10228288 | | 8/1998 |
| JP | 2000-224269 | | 8/2000 |
| WO | 0130127 | A2 | 5/2001 |
| WO | 2005059891 | A1 | 6/2005 |

OTHER PUBLICATIONS

Maekawa et al., "A wireless, networked musical environment consisting of wearable MIDI instruments," Telecommunications, 2003. ICT 2003. 10th International Conference on Feb. 23-Mar 1, 2003, Piscatway, NJ, USA, IEEE, vol. 2, pp. 1731-1734.

*Primary Examiner*—Jeffrey Donels
(74) *Attorney, Agent, or Firm*—Peane & Gordon LLP

(57) ABSTRACT

The hearing device is MIDI-compatible, wherein MIDI stands for Musical Instrument Digital Interface. The hearing device can be adapted to communicating and/or loading and/or storing and/or interpreting and/or generating data compliant with the MIDI Protocol, also referred to as MIDI messages. Acknowledge sounds of the hearing device an be controlled by MIDI data, or music can be played to a user of the hearing device based on MIDI data. The hearing device can be a hearing aid, a headphone, an earphone, a hearing protection device, a communication device or the like.

28 Claims, 1 Drawing Sheet

MIDI-COMPATIBLE HEARING DEVICE

TECHNICAL FIELD

The invention relates to a hearing device. The hearing device can be a hearing aid, worn in or near the ear or (partially) implanted, a headphone, an earphone, a hearing protection device, a communication device or the like. The invention relates furthermore to a method of operating a hearing device and the use of MIDI—i.e., Musical Instrument Digital Interface—compliant data in a hearing device.

STATE OF THE ART

Today, many hearing devices, e.g., hearing aids, are capable of generating some simple acoustic acknowledge signals, e.g., a beep or double-beep signaling that a first or a second hearing program has been chosen by the user of the hearing device.

In WO 01/30127 A2 a hearing aid is disclosed, which allows to feed user-defined audio-signals into the hearing device, which user-defined audio-signals can then be used as acknowledge signals.

U.S. Pat. No. 6,816,599 discloses an ear-level electronic device within a hearing aid, capable of generating electrical signals representing music. By means of a pseudo-random generator extremely long sequences of music can be created which can produce a sensation of relief to persons suffering tinnitus.

In the world of electronic music, where music synthesizers, electronic keyboards, drum machines and the like are used, the Musical Instrument Digital Interface (MIDI) protocol has been introduced in 1983 by the MIDI Manufacturers Association (MMA) as a new standard for digitally representing musical performance information. A number of specifications of MIDI-related data formats have been issued by the MMA within the last 10 to 20 years. Within the last couple of years, MIDI-compliant data (MIDI data) have found application in mobile phones, where MIDI data, in particular data compliant with the Scalable Polyphony MIDI (SP-MIDI) specification, introduced in February 2002, are used for defining telephone ring tones.

SUMMARY OF THE INVENTION

One object of the invention is to create a hearing device that provides for an alternative way of defining sound information to be perceived by a user of the hearing device.

Another object of the invention is to provide for a hearing device with an enhanced compatibility to other equipment.

Another object of the invention is to provide for a hearing device which can easily be individualized and adapted to a user's taste and preferences.

These objects are achieved by a hearing device according to patent claim 1.

In addition, the respective method for operating a hearing device and the use of MIDI compliant data in a hearing device shall be provided.

The hearing device according to the invention is MIDI compatible, i.e., Musical Instrument Digital Interface compatible.

MIDI specifications are defined by the MIDI Manufacturers Association (MMA). In 1983 the Musical Instrument Digital Interface (MIDI) protocol was introduced by the MMA.

In the MMA various companies from the fields of electronic music and music production are joined together to create MIDI standards and specifications assuring compatibility among MIDI-compatible products. Since 1985 the MMA has issued about 11 new specifications and adopted about 38 sets of enhancements to MIDI.

Unlike MP3, WAV, AIFF and other digital audio formats, MIDI data do not (or at least not only) contain recorded sound or recorded music. Instead, music is described in a set of instructions (parameters) to a sound generator, like a music synthesizer. Therefore, playing music via MIDI (i.e., using MIDI data) implies the presence of a MIDI-compatible sound generator or synthesizer. MIDI data usually comprise messages, which can instruct the synthesizer, which notes to play, how loud to play each note, which sounds to use, and the like. This way, MIDI files can usually be very much smaller than recorded digital audio files.

The current MIDI specification is MIDI 1.0, v96.1 (second edition). It is available in form of a book: ISBN 0-9728831-0-X. Originally, the MIDI specification defined a physical connector and, in what can be referred to as the MIDI Message Specification, also named MIDI protocol, a message format, i.e., a format of MIDI messages. Some years later, a file format (storage format) called Standard MIDI is File (SMF) was added. An SMF file contains MIDI messages (i.e., data compliant with the MIDI protocol), to which a time stamp is added, in order to allow for a playback in a properly timed sequence.

MIDI specifications or MIDI-related specifications (companion specifications), issued by the MMA, of (potential) interest for the invention comprise at least the following ones:

- the MIDI protocol defining MIDI messages (see above)
- the Standard MIDI file format (SMF), see above;
- the MIDI Machine Control specification (MMC), meant for controlling machines like mixing consoles or other audio recording equipment;
- the MIDI Show Control specification (MSC), meant for controlling lamps and machines like smoke machines;
- the MIDI Time Code specification (MTC), for synchronizing MID equipment;
- the General MIDI Specifications (GM/GM 1, GM 2, GM Lite), defining several minimum requirements (e.g., on polyphony) and allocation of standard sounds, in order to assure some standard performance compatibility among MIDI instruments so as achieve similarly sounding results when using different platforms;
- the Scalable Polyphony MIDI specification (SP-MIDI, issued February 2002, corrected November 2001), which defines MIDI messages allowing a sound generator to play, in a well-defined way, music that usually would require a higher polyphony (i.e., a higher number of simultaneously generatable sounds) than the sound generator is capable of producing; in other words, depending on the available polyphony of the sound generator, tones are played and not played, in a well-defined way;
- a file format called DownLoadable Sounds Format (DLS Level 1, DLS-1, version 1.1b issued September 2004, DLS Level 2, DLS-2, version 2.1, amended November 2004), which defines a way of providing sounds (samples, WAV files) and articulation parameters for the sounds, so that at least a part of the notes of a MIDI song can be heard with original sounds instead of with sounds given by the sound generator, which are often not very close to the original;
- a file format called eXtensible Music Format (XMF), version 2.0 issued in December 2004, which defines a standard for gathering in one single file a number of different data (e.g., SMF files and DLS data) required to assure a consistent audio playback of MIDI note-based information on various platforms;

the SMF w/DLS File Format Specification (February 2000) defining a file format for bundling an SMF file with DLS data, known as RMID file format, which is outdated today and, since November 2001, recommended to be replaced by the XMF file format (see above);

the DLS format for mobile devices (MDLS) issued September 2004, based on DLS-2;

the Mobile XMF specification, version 2.0 issued September 2004 together with MDLS; and the Standard MIDI File (SMF) Lyrics Specification (SMF Lyric Meta Event Definition), issued January 1998, which defines a recommended way of implementing lyrics in SMF files.

MIDI specifications, definitions, recommendations and further information about MIDI can be obtained from the MMA, in particular from via the internet at http://www-.midi.org.

Through providing the hearing device with MIDI compatibility, a new way of defining sound in a the hearing device is provided, in particular a new way of defining sound information to be perceived by a user of the hearing device. The hearing device is provided with an enhanced compatibility to other equipment, in particular other MIDI compatible equipment. The hearing device can easily be individualized and adapted to the user's taste and preferences. A well-tested and efficient way of representing sound is implemented into the hearing device, which can be advantageous, in particular when the sound is complex, e.g., due to polyphony or length and number of notes to be played, respectively.

The term MIDI data shall, at least within the present patent application, be understood as data compliant with at least one MIDI specification (or MIDI-related specification), in particular with one of those listed above.

More specifically, the term MIDI data can be interpreted as data compliant with the (current) MIDI protocol, i.e., MIDI messages (including data of SMF files).

The hearing device according to the invention can be adapted to comprising MIDI data.

The hearing device can be adapted to communicating and/or loading and/or storing and/or interpreting and/or generating:

data compliant with the MIDI Protocol (messages compliant with the MIDI Message Specification; MIDI messages), and/or Standard MIDI Files, and/or files in the eXtensible Music Format, and/or Mobile XMF files, and/or data compliant with the SP-MIDI specification, and/or DLS data, i.e., data compliant with the DownLoadable Sounds Format, and/or Mobile DLS data, and/or MMC data, and/or MSC data, and/or MTC data, and/or General MIDI data, and/or RMID files, and/or files compliant with the SMF Lyric Meta Event Definition.

The hearing device can comprise a MIDI interface. The MIDI interface allows for a simple communication of MIDI data with other devices.

The hearing device can comprise a sound generator adapted to interpreting MID data. An efficient control of the sound generation can thus be achieved, which, in addition, is compatible with a wide range of other sound generators. The hearing device can comprise a unit for interpreting MIDI data. That unit may be realized in form of a processor or a controller or in form of software. MIDI data can be transformed into other information, e.g., information to be given to a sound generator within the hearing device so as to have a desired sound or piece of music played.

One way of using MIDI data in a hearing device is in conjunction with the generation of sound to be perceived by the hearing device user. E.g., acknowledge sounds, also called feedback sounds, which are played to the user upon a change in the hearing device's function, e.g., when the user changes the loudness (volume) or another setting or is program, or when some other user's manipulation shall be acknowledged, or when the hearing device by itself takes an action, e.g., by making a change, e.g., if, in the case of a hearing aid, the hearing aid chooses, in dependence of the acoustical environment, a different hearing program (frequency-volume settings and the like), or when the hearing device user shall be informed that a hearing device's battery is low.

It is also possible to use MIDI in a hearing device in conjunction with musical signals to be played to the user of the hearing aid. And it is also possible to use MIDI in a hearing device in conjunction with guiding signals, which help to guide the user, e.g., during a fitting procedure, during which the hearing device is adapted to the user's hearing preferences.

Furthermore, according to today's trend to individualization, it is possible to personalize a hearing device by aid of MIDI. E.g., said acknowledge sounds could be loaded into the hearing device in form of MIDI data. From the hearing device manufacturer or from a third party, the hearing device user could receive, possibly against payment, MIDI data for such sounds, chosen according to the user's taste.

It is possible to load such MIDI data to the hearing device, which define the sound to be played to the hearing device user when the user's (possibly mobile) telephone rings. And even, a number of ring sounds can be loaded into the hearing device, wherein the sound to be played to the hearing device user when the user's telephone rings, is chosen in dependence of the person who calls the hearing device user, or, more precisely, depending on the telephone number of the telephone apparatus from which the hearing device user is called.

This may be accomplished, e.g., by either sending MIDI data to the hearing device upon an incoming call in the telephone, or by having MIDI data stored in the hearing device, which describe ring tones, and upon an incoming call in the telephone, the hearing device receives not the actual MIDI data, but a link instructing the hearing device, which of the MIDI-based ring tones stored in the hearing device to play to the hearing device user.

In addition, it is possible to use MIDI data in a hearing device in conjunction with speech synthesis. E.g., speech signals stored in the hearing device could be addressed or controlled by MIDI data. Or speech signals, be it synthesized or sampled, could be encoded in MIDI, e.g., using the DownLoadable Sounds Format (DLS) of MIDI.

Furthermore, it is possible to listen to music (pop, classic or others) encoded in MIDI with the hearing device. A hearing device comprising a sound generator could interpret MIDI data loaded into the hearing device and generate the corresponding music thereupon. Various musical pieces and works are today already available in form of MIDI data. Music could thus be generated within the hearing device and played to the hearing device user without the need for external sound generators like Hifi consoles or music synthesizers plus amplifiers. The MIDI DLS standard could be used here to achieve a particularly good and realistic audio reproduction.

In several of the above-described embodiments, the hearing device can be considered to comprise a converter for converting MIDI data into audio signals to be perceived (usually after an electro-mechanical conversion) by the hearing device user. Such a converter can be or comprise a signal processor, e.g., a digital signal processor (DSP), the converter can be or comprise a controller plus a sound generator or a controller plus a DSP. Also a sound memory may be comprised in the converter.

The hearing device is typically an ear level device. It may be worn partially or in full in or near the user's ear, or it may fully or in part be implemented, e.g., like a cochlea implant.

A hearing system according to the invention comprises a hearing device according to the invention. It may comprise one or more external microphones, a remote control or other parts.

According to the invention, the method of operating a hearing device, comprises at least one of the following steps:

communicating MIDI data;

loading MIDI data;

storing MIDI data;

interpreting MIDI data;

generating MIDI data;

wherein MIDI stands for Musical Instrument Digital Interface.

In one embodiment, the method comprises the step of generating sound in said hearing device based on said interpretation of said MIDI data.

The advantages of the methods correspond to the advantages of corresponding hearing devices.

Further preferred embodiments and advantages emerge from the dependent claims and the figures.

BRIEF DESCRIPTION OF THE DRAWINGS

Below, the invention is illustrated in more detail by means of embodiments of the invention and the included drawings. The figures show.

The reference symbols used in the figures and their meaning are summarized in the list of reference symbols. Generally, alike or alike-functioning parts are given the same reference symbols. The described embodiments are meant as examples and shall not confine the invention.

DETAILED DESCRIPTION OF THE INVENTION

Figure 1:
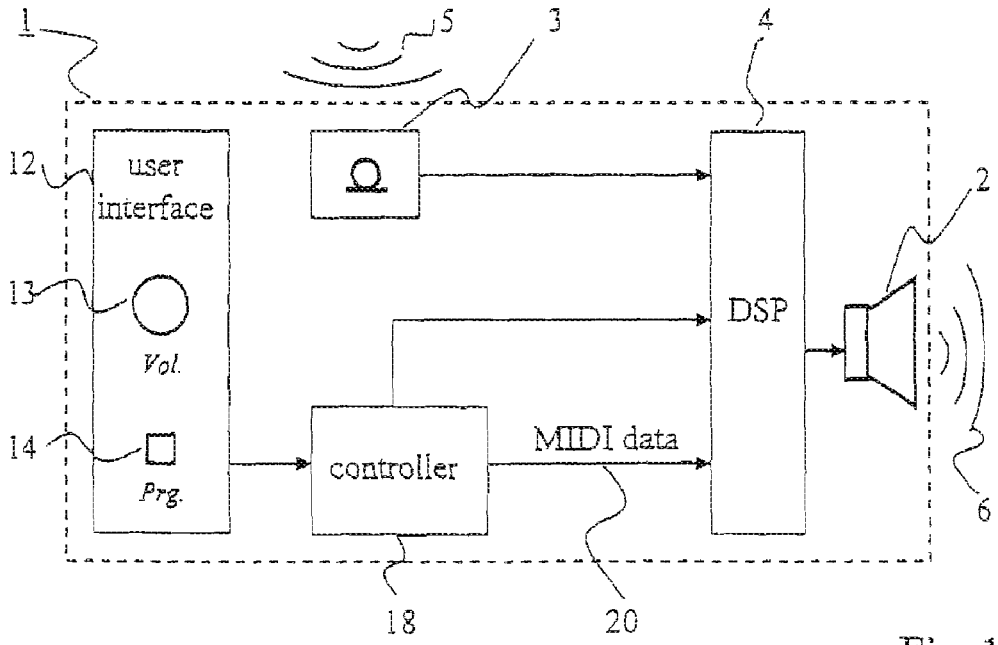
FIG. 1 a block diagram of a first hearing device.

FIG. 1 shows a block diagram of a hearing device 1, e.g., a hearing aid, a hearing protection device, a communication device or the like. It comprises an input transducer 3, e.g., as indicated in FIG. 1, a microphone for converting incoming sound 5 into an electrical signal, which is fed into a signal processor 4, in which the signal can be processed and amplified. It is, of course, possible to foresee a telephone coil as an input transducer. An amplification may take place in a separate amplifier. The processed amplified signal is then, in an output transducer 2, converted into a signal 6 to be perceived by the user of the hearing device. When, e.g., the transducer 2 is a loudspeaker, the signal 6 is an acoustical wave. In case of an implanted device 1, the signal 6 can be an electrical signal.

The device 1 of FIG. 1 furthermore comprises a user interface 12, through which the hearing device user may communicate with the hearing device 1. It may comprise a volume wheel 13 and a program change button 14. A controller 18, which controls said signal processor (DSP) 4, can receive input from said user interface 12. Said controller 18 can communicate with the signal processor via MIDI data 20. For example, a sound signal to be played to the user when the user selects a certain program (via said program change button 14), can be encoded in such MIDI data 20. The DSP 4 can function as a converter for converting MIDI data 20 into sound, that sound is to be perceived by the user after it has been converted in output transducer 2. For example, the MIDI data 20 instruct the DSP 4 to play a certain melody by passing to the DSP 4 the information, which sound wave to use, and for which duration and at which volume (loudness) to generate sound at which pitch. Also other instructions to the DSP 4 can be encoded in the MIDI data 20.

The embodiment of FIG. 1 exemplifies a rather internal use of MID data within a hearing device.

Figure 2:
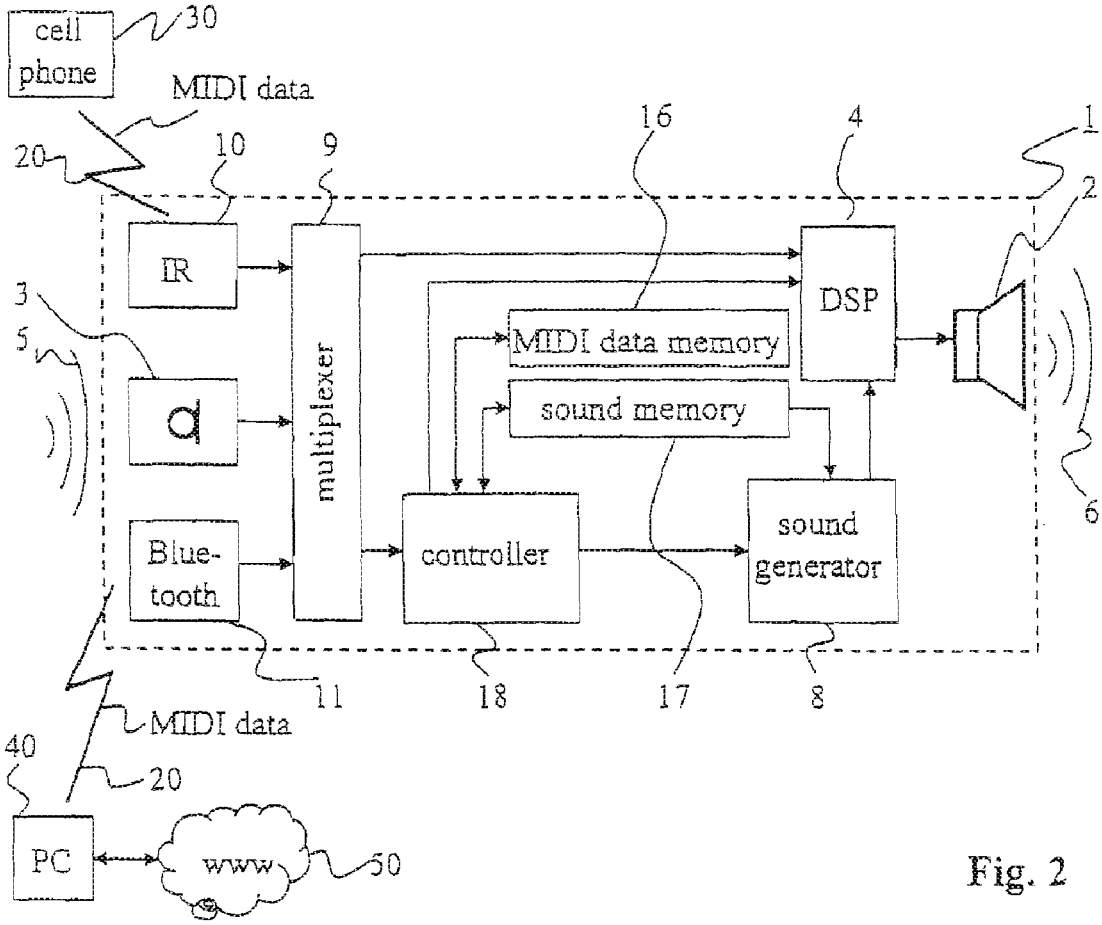
FIG. 2 a block diagram of a second hearing device.

FIG. 2 shows a hearing device 1, which can communicate MIDI data 20 with external devices. In addition to an input transducer 3, the hearing device 1 comprises an infrared interface 10 and a bluetooth interface 11 for receiving external input and possibly send output, e.g., MIDI data, to an external device. Bluetooth is a well-known wireless standard in computing and mobile communication. Other interfaces, e.g., a radio frequency/FM interface, may be provided, and some interfaces may be embodied as an add-on to the hearing device. A multiplexer 9 is provided for selecting, which signals to forward to a DSP 4 and a controller 18, respectively. A user interface 12 like the one in the embodiment of FIG. 1 may also be provided.

The hearing device 1 can receive MIDI data 20, as indicated in FIG. 2 from a mobile phone 30, from a computer, or from another device via said infrared interface 10. The hearing device 1 can receive MIDI data 20, as indicated in FIG. 2 from a computer 40, from a mobile phone, or from another device via said Bluetooth interface 11. The computer may be adapted to be connected to the world wide web 50, from where suitable MIDI data could be loaded into the computer and then communicated to the hearing device 1.

Of course, besides wireless connections, the hearing device 1 may also have the possibility to have a wire-bound connection for communicating with external or added-on devices.

The controller 18 not only gives instructions to the DSP 4, but has associated a MIDI data memory 16 for storing MIDI data 20, and a sound memory 17, in which sound data like digitally sampled sounds can be stored. A sound generator 8 is provided, which is controlled by controller 18 and can access said sound memory 17. In the DSP 4, sound generated by the sound generator 8 can be processed and, after amplification, fed to the output transducer 2.

The MIDI data memory 16 may store externally-loaded MIDI data or MIDI data generated in the hearing device 1. The sound memory 17 may store externally-loaded sounds, e.g., loaded via MIDI DownLoadable Sounds (DLS) data, or may store pre-programmed sounds (pre-stored sounds). The memories 16 and 17 can, of course be realized in one single memory and/or be integrated, e.g., in the controller 18.

The arrows indicating the interconnection of the various parts of the hearing devices in FIGS. 1 and 2 may partially be realized as bidirectional interconnections, even if in FIGS. 1 and/or 2 the corresponding arrow may only be unidirectional.

One of many ways to make use of MIDI data 20 in the hearing device 1 may be to load via one of the interfaces 10,11

MIDI data describing a telephone ring tone and store the MIDI data in the MIDI data memory 16 and recall said MIDI data when the mobile phone 30 informs the hearing device 1 that a telephone call is arriving. The ring tone (music and possibly also sound) encoded in the MIDI data is thereupon played to the hearing device user by the sound generator 8 via the DSP 4 and the transducer 2.

Another use of MIDI data 20 in the hearing device 20 is to receive via one of the interfaces 10, 11 from, e.g., the computer 40, MIDI data, which describe a piece of music the user wants to listen to. The sound memory 17 may contain (pre-stored) sounds according to the General MIDI standard (GM). The controller 18 instructs the sound generator to generate notes according to the MIDI data 20 with sounds from the sound memory 17 having the General MIDI sound number given in the MIDI data 20. This way, musical pieces can be generated, according to loaded MIDI instructions, fully within the hearing device 1. Of course, it is also possible to load all MIDI data for the piece of music first, store them in the MIDI data memory 16, and play them later, e.g., upon a start signal provided by the user through a user interface, like the user interface 12 in FIG. 1.

Another use of MIDI data 20 in the hearing device 20 is to load via one of the interfaces 10,11 MIDI data 20, which contain speech sounds, e.g., when the MIDI data 20 are MIDI DLS data. For example, to different (musical) keys (C4, is C#4, . . . ) a sampled sound of different vowels and consonants can be assigned, or even syllables, full words or sentences. By means of sounds of such a sound set, the user could be informed about the status of a hearing device's battery or about some user manipulation of a user interface or the like in form of speech messages like "battery is low, please insert a new battery soon" or "volume is adjusted to 8". The text would be encoded in sequences of musical keys, with durations, loudness volumes and so on, just like a piece of music, in MIDI data.

Many further useful uses of MIDI data in a hearing device are possible.

LIST OF REFERENCE SYMBOLS

1 hearing device
2 transducer, output transducer, loudspeaker, receiver
3 transducer, input transducer, microphone
4 signal processor, digital signal processor, DSP
5 sound, incoming sound, incoming audio signal
6 signals to be perceived by the user, sound, outgoing sound
8 sound generator
9 multiplexer
10 infrared interface
11 Bluetooth interface
12 user interface, set of controls
13 control, volume wheel
14 control, program change knob
16 MIDI data memory
17 sound memory
18 controller, processor chip
20 MIDI data, MIDI file, MIDI message
30 cellular phone, mobile phone
40 computer, personal computer
50 worldwide web, www

The invention claimed is:

1. Hearing device, comprising:

a converter for converting MIDI data into an acknowledge sound to be perceived by a user of the hearing device to inform the user of a condition, wherein said acknowledge sound conveys information about said condition to the user and is generated by the hearing device while functioning as a hearing aid or as a hearing protection device.

2. The hearing device according to claim 1, wherein the condition indicates a status of a battery of the hearing device.

3. The hearing device according to claim 1, wherein the condition is sensed by the hearing device.

4. The hearing device according to claim 1, wherein the condition is a condition of the hearing device.

5. The hearing device according to claim 1, wherein the acknowledge sound is played to the user upon sensing the condition.

6. The hearing device according to claim 1 further comprising one or more of:

an interface adapted to at least one of communicate and load data compliant with a MIDI Protocol to the hearing device;

a memory adapted to store data compliant with the MIDI Protocol; and a sound generator adapted to at least one of interpret and generate data compliant with the MIDI Protocol.

7. The hearing device according to claim 6, wherein said data compliant with the MIDI Protocol comprises one or more of one or more Standard MIDI Files;

one or more extensible Music Format files;

data compliant with a DownLoadable Sounds Format;

data compliant with a Scalable Polyphony MIDI specification.

8. The hearing device according to claim 1, comprising an interface for receiving, sending, or both receiving and sending messages compliant with the MIDI Message Specification.

9. The hearing device according to claim 8, wherein said messages compliant with the MIDI Protocol comprise one or more of one or more Standard MIDI Files;

one or more extensible Music Format files;

data compliant with a DownLoadable Sounds Format;

data compliant with a Scalable Polyphony MIDI specification.

10. The hearing device according to claim 1, further comprising a sound generator adapted to interpret MIDI data.

11. The hearing device according to claim 1, wherein the condition is an internal condition of the hearing device.

12. The hearing device according to claim 1, wherein the acknowledge sound comprises speech sounds encoded as MIDI data.

13. The hearing device according to claim 1, wherein the hearing device is a hearing aid, a hearing protection device, or both a hearing aid and a hearing protection device.

14. A hearing system, comprising a hearing device according to one of claims 1 to 13, and further comprising at least one peripheral input device that transmits a signal to be transmitted to the hearing device.

15. The hearing system according to claim 14, wherein the at least one peripheral input device comprises one or both of: an external microphone and a remote control.

16. Method of operating a hearing device, comprising the steps of:

operating the hearing device as a hearing aid or as a hearing protection device;

sensing a condition while operating the hearing device as the hearing aid or as the hearing protection device;

in the hearing device and responsive to said sensing said condition, converting MIDI data into an acknowledge sound that indicates said condition; and audibly presenting said acknowledge sound to be perceived by said user of the hearing device to thereby convey information about said condition to said user.

17. The method according to claim 16, wherein said sensing said condition is carried out by the hearing device.

18. The method according to claim 16, wherein said condition is a condition of the hearing device.

19. The method according to claim 16, comprising one or more of communicating data compliant with a MIDI Protocol to the hearing device;

loading data compliant with the MIDI Protocol into the hearing device;

storing data compliant with the MIDI Protocol in the hearing device;

interpreting data compliant with the MIDI Protocol in the hearing device;

generating data compliant with the MIDI Protocol in the hearing device.

20. The method according to claim 19, wherein said data compliant with the MIDI Protocol comprises one or more of one or more Standard MIDI Files;

one or more extensible Music Format files;

data compliant with a DownLoadable Sounds Format;

data compliant with a Scalable Polyphony MIDI specification.

21. The method according to claim 16, wherein the hearing device is a hearing aid, a hearing protection device, or both a hearing aid and a hearing protection device.

22. The method according to claim 16, further comprising loading a personalized acknowledge sound into the hearing device as MIDI data from an external device.

23. The method according to claim 16, wherein the acknowledge sound comprises speech sounds encoded as MIDI data.

24. The method according to claim 16, further comprising presenting ambient sounds to the user of the hearing device while operating the hearing device as a hearing aid or as a hearing protection device.

25. A hearing aid to be worn by a user with diminished hearing ability for presenting to the user audible sounds at a suitable volume level that enables the user to perceive the audible sounds, the hearing aid comprising:

a microphone for converting incoming sound from an ambient environment of the hearing aid into an electrical signal;

an amplifier that amplifies a volume level of the incoming sound represented by the electrical signal to the suitable volume level for the user and outputs an amplified signal;

a sensing unit for sensing an internal condition of the hearing device;

a converter for interpreting MIDI data and converting the MIDI data into an acknowledge sound in response to the sensed internal condition of the hearing device that indicates the sensed internal condition of the hearing device when presented to the user; and an output transducer that converts the amplified signal and the acknowledge sound into audible output signals to be presented to the user.

26. The hearing aid according to claim 25, wherein said internal condition is a condition of a battery of the hearing device.

27. The hearing aid according to claim 25, further comprising an interface for communicating with an external device to load personalized acknowledge sounds as MIDI data.

28. The hearing aid according to claim 25, wherein the acknowledge sound is a speech signal encoded as MIDI data to be converted into the output signal.

* * * * *

UNITED STATES PATENT AND TRADEMARK OFFICE

CERTIFICATE OF CORRECTION

PATENT NO. : 7,705,232 B2
APPLICATION NO. : 12/269985
DATED : April 27, 2010
INVENTOR(S) : Raoul Glatt It is certified that error appears in the above-identified patent and that said Letters Patent is hereby corrected as shown below:

In the specification, column 4, lines 4-10, the sentences "The hearing device can comprise a unit for interpreting MIDI data. That unit may be realized in form of a processor or a controller or in form of software. MIDI data can be transformed into other information, e.g., information to be given to a sound generator within the hearing device so as to have a desired sound or piece of music played." should be a separate paragraph In the specification, column 6, line 20, replace "MID" with -- MIDI --

Signed and Sealed this

Thirty-first Day of August, 2010

David J. Kappos

David J. Kappos
*Director of the United States Patent and Trademark Office*